United States Patent [19]

Birnbach et al.

[11] Patent Number: 4,950,962

[45] Date of Patent: Aug. 21, 1990

[54] HIGH VOLTAGE SWITCH TUBE

[75] Inventors: Curtis Birnbach, Bronx; Jay Tanner, Nesconset, both of N.Y.; Richard Heese, Westmont, Canada

[73] Assignee: Quantum Diagnostics, Ltd., Hauppauge, N.Y.

[21] Appl. No.: 261,910

[22] Filed: Oct. 25, 1988

Related U.S. Application Data

[63] Continuation-in-part of Ser. No. 151,258, Feb. 1, 1988, abandoned, which is a continuation of Ser. No. 860,414, May 7, 1987, Pat. No. 4,723,263, which is a continuation-in-part of Ser. No. 736,136, May 20, 1985, Pat. No. 4,670,894.

[51] Int. Cl.[5] ..... H01J 17/00

[52] U.S. Cl. ..... 315/351; 313/597; 313/308; 313/293

[58] Field of Search ..... 315/349, 350, 351; 313/293, 295, 308, 595, 597; 378/122, 136, 138

[56] References Cited

U.S. PATENT DOCUMENTS 2,155,824 4/1939 Harries ..... 313/308

4,723,263 2/1988 Birnbach et al. ..... 378/122

*Primary Examiner*—Robert J. Pascal

*Attorney, Agent, or Firm*—Ostrolenk, Faber, Gerb & Soffen

[57] ABSTRACT

A high voltage switch tube with a central cathode cylindrically symmetric to and surrounded by a tubular anode, with a grid interposed between the cathode and anode. A high negative voltage is applied to the cathode, but the flow of electrons to the anode is blocked by the grid which is held near cathode potential. After a space charge is created at the grid by electrons from the cathode, the grid is pulsed to ground potential, releasing electrons from the cathode to yield a very high current pulse. The cathode is preferably a graphite foam sleeve mounted on a support structure.

14 Claims, 3 Drawing Sheets

HIGH VOLTAGE SWITCH TUBE

RELATED APPLICATIONS

This is a continuation-in-part of Ser. No. 151,258, filed Feb. 1, 1988, now abandoned, which is a continuation of Ser. No. 860,414, filed May 7, 1987, now U.S. Pat. No. 4,723,263 entitled X-RAY SOURCE, which is a continuation-in-part of Ser. No. 736,136, filed May 20, 1985, now U.S. Pat. No. 4,670,894 entitled X-RAY SOURCE TUBE EMPLOYING COLD CATHODE GAS DISCHARGE TUBE WITH COLLIMATED BEAM. The disclosures of these related applications are herein incorporated by reference.

BACKGROUND OF THE INVENTION

1. Field of the Invention

The present invention relates generally to a high voltage switch tube and, more specifically, to a cold cathode switch tube based upon the same principles of operation of the inventions described in the above-identified parent applications.

2. Description of the Related Art

The simplest device for producing a short, high voltage pulse is a conventional spark gap. Although crude, a spark gap provides a high voltage pulse which is satisfactory for a variety of purposes, such as igniting fuel or serving as a electrical trigger. In the latter type of application, the spark gap has its limitations, because the high voltage pulse is not consistent in width or amplitude. Hot cathode thyratrons have also been used to provide high voltage pulses, but again, the pulse length is not well defined or consistent because the grid of the thyratron loses control once the device is fired.

SUMMARY OF THE INVENTION

Accordingly, there is a desire in the industry for a device which produces a narrow, high voltage pulse which is consistent and controllable. The present invention achieves this objective by implementing the cold cathode principle of operation, disclosed in the above-noted parent applications, into a high voltage switch tube More specifically, the invention is a high voltage switch which employs an elongated large area cold cathode axially symmetric to, and surrounded by, an elongated anode, and a grid which acts as a gate interposed between the cathode and the anode. The cathode is held at a first potential and the anode is held at a second potential. A pulse from the first potential to the second potential is applied to the grid, which releases elections from the cathode to the anode, producing a very short, high voltage pulse with a substantially constant voltage $KV_{peak}$.

In the preferred embodiment of the invention, the cathode is formed of a graphite foam sleeve mounted on a support structure. The cathode, anode and grid are preferably cylindrical, the cathode having a finger shape, the grid having the shape of a cylindrical set of longitudinally disposed Venetian blinds, and the surrounding anode having the shape of a cylinder open at one end. The distance between the cathode and anode is at least four times the distance between the cathode and the grid.

The cathode and anode are preferably coupled to their respective first and second potentials by wide flat straps to substantially reduce lead inductance and conductance. The pulse fed to the grid may be generated by feeding a square wave into a pulse transformer The chamber housing the cathode, anode and grid is held under vacuum, preferably by getter pumps.

The high voltage switch of the present invention has been constructed and its output pulse has been measured to have a current of 800,000 A of 8 ns duration, which is vastly superior to an ordinary spark gap. The invention can be used as the switching tube for controlling the grid in the X-ray source described and claimed in the above-identified related patents.

Advantageously, the grid of the present invention can be used to control the duration of the output pulse, making the switch tube much more versatile than prior art devices.

BRIEF DESCRIPTION OF THE DRAWINGS

Other features and advantages of the present invention will become apparent when the following detailed description is read in conjunction with the accompanying drawings, in which.

DETAILED DESCRIPTION OF THE PREFERRED EMBODIMENT

Figures 1, 2, 3:
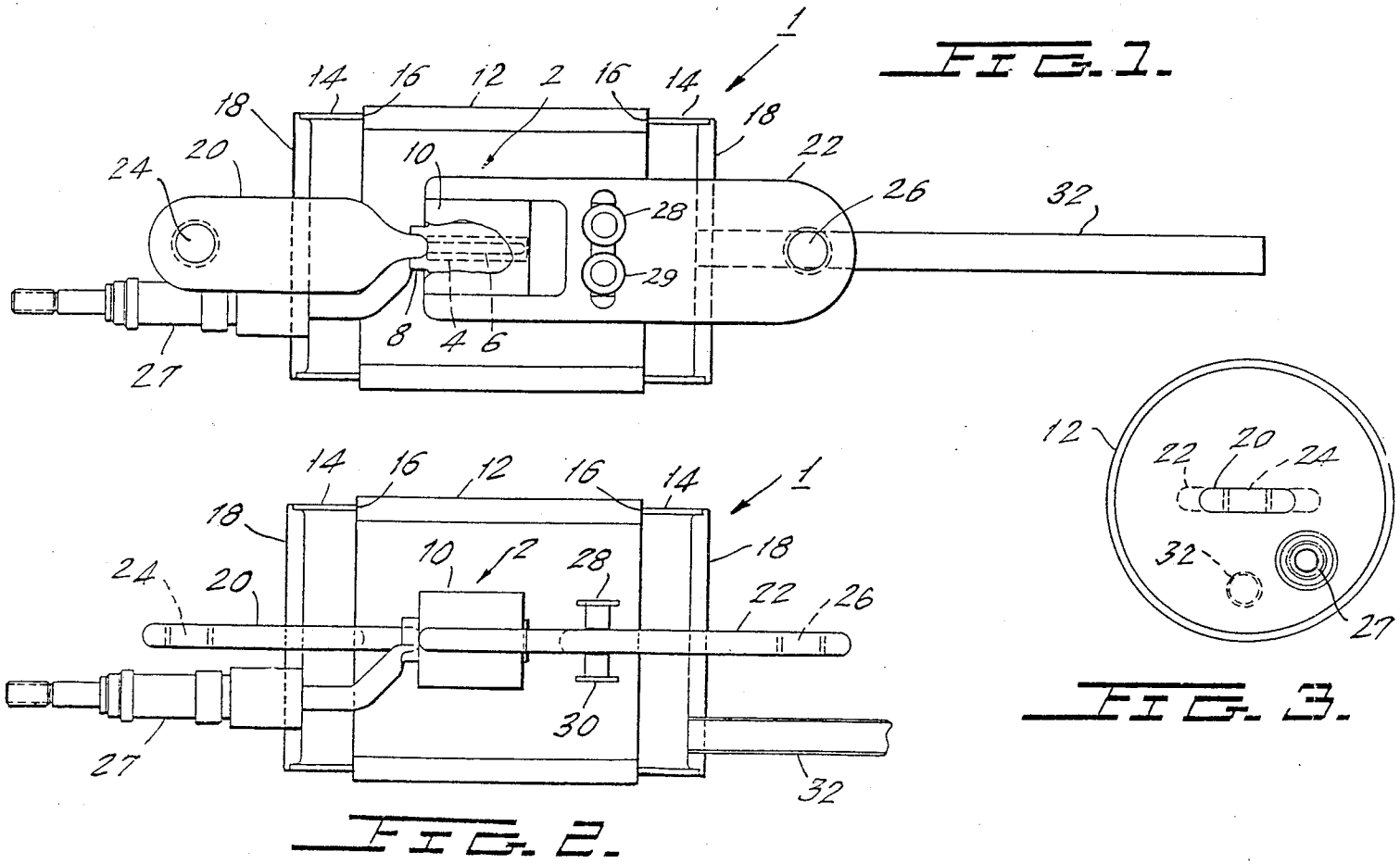
FIG. 1 is a breakaway top view of the preferred embodiment of the present invention.
FIG. 2 is an exposed top view of the preferred embodiment of the present invention.
FIG. 3 is a side view of the preferred embodiment of the present invention.

Referring first to FIG. 1–3, the preferred implementation of the invention is shown in detail. As can be seen, the cathode/anode/grid chamber 2 is cylindrically shaped. The cathode 4 is centrally located within chamber 2, and is formed of a graphite foam sleeve mounted around a support structure 6 to provide an optimum surface for the emission of electrons. Spaced from and surrounding cathode 4 is a cylindrical grid 8, which serves to block electron emission from cathode 4 between firings, as discussed in further detail below. Spaced from and surrounding grid 8 is an anode 10, which has the shape of a cylinder open at one end.

Figure 4:
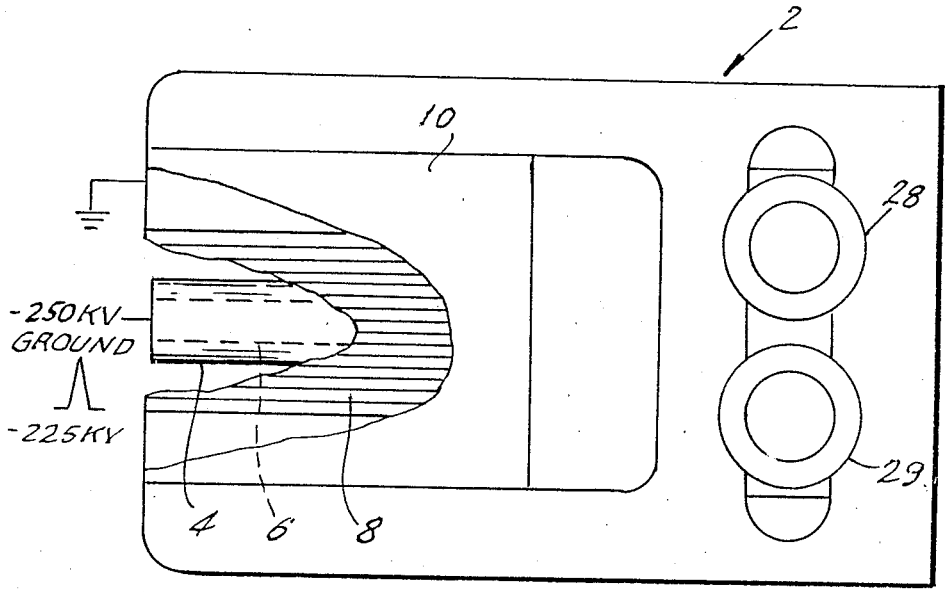
FIG. 4 is a magnified view of the cathode/anode/grid configuration of the present invention.

Chamber 2 and its components are better seen in the magnified and cut-away view of FIG. 4. In this view, grid 8 is depicted in its preferred form as a cylinder of slats in a Venetian blind configuration. The radial distance from cathode 4 to anode 10 must be at least four times the radial distance from cathode 4 to grid 8 in order for the device to operate properly.

The switch tube of the present invention has the same electrical connections and operates on the same principles as the devices described in the above-listed parent applications. More specifically, as shown in FIG. 4, cathode 4 is connected to a potential of −250 KV, anode 10 is connected to ground potential and grid 8 is rapidly switchable between −225 KV (its normal state) and ground by the application of a pulse to ground from a pulse transformer. Obviously, the device can be operated at lower or higher voltages (up to 500 KV) depending upon the particular application.

In the operation of the device, the flow of electrons from cathode 4 to anode 10 is blocked by the presence of grid 8, which is at a potential of −225 KV, just 10% less than cathode 4 (the difference being necessary to account for the voltage gradient between cathode 4 and anode 10). However, after a space charge is created at grid 8, a sharp ground pulse is applied to the grid, which releases electrons from cathode 4 to anode 10, producing a very high current, high voltage pulse of about 8 nsec duration.

Figure 5:
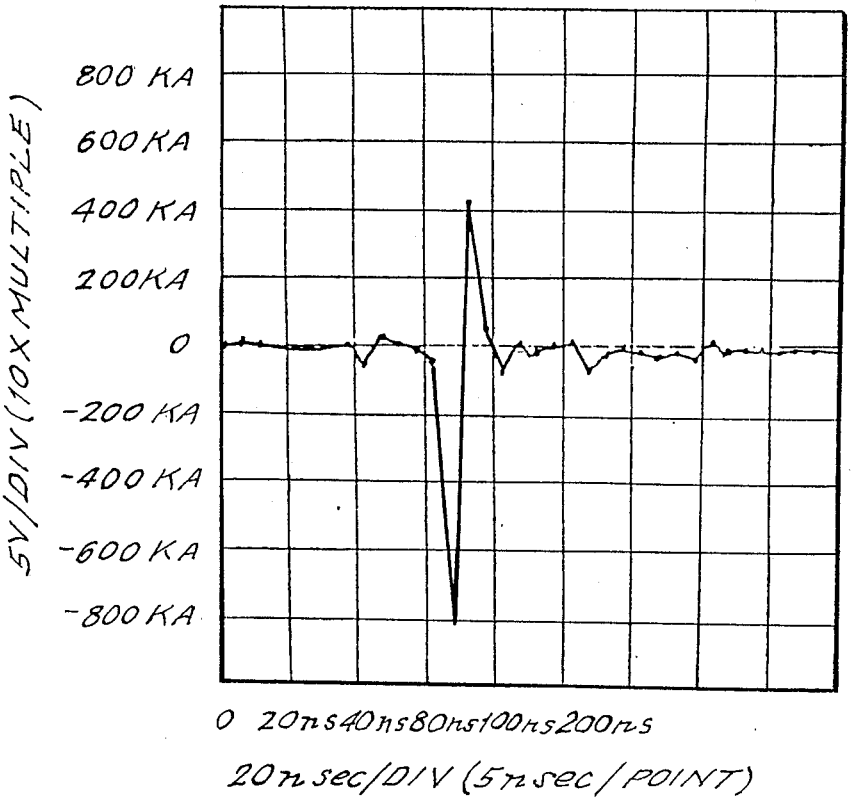
FIG. 5 is a waveform trace of the current output when the present invention is switched.

An actual waveform trace of the current output from the firing of the present invention is shown in FIG. 5. The horizontal scale is 20 nsec/div and the vertical scale is 200 KA/div. As can be seen, the initial negative going current spike has a magnitude of 800 KA, a rise time of about 4 nsec, a fall time of about 3 nsec, and a total width of about 8 nsec. Even the backward ring has an amplitude of over 400 KA. These figures are all orders of magnitude greater than that obtainable from the prior art devices described above.

Moreover, the presence of grid 8 in the present invention provides control of the output pulse. Unlike prior art hot cathode thyratrons in which the grid loses total control once the device is fired, the grid 8 of the present invention can be switched off prematurely to limit output pulse duration and total current flow. Accordingly, the invention not only provides greater output than prior art devices, but is also much more versatile.

Figure 6:
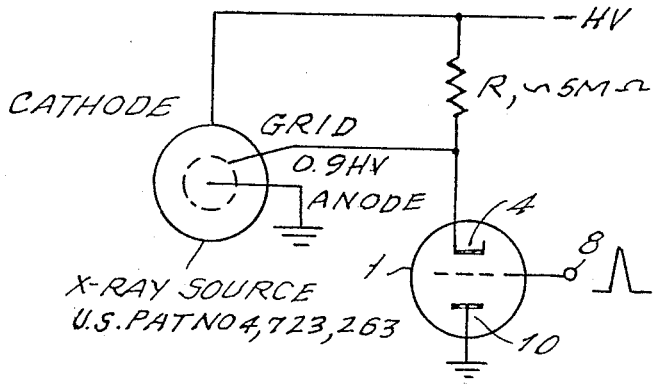
FIG. 6 is a schematic showing the present invention used as the switching tube for the X-ray source of U.S. Pat. No. 4,723,263.

One application of the present invention is as a switching tube for controlling the grid potential in the X-ray source described and claimed in U.S. Pat. No. 4,723,263. FIG. 6 is an electrical schematic of such a set-up, with the present invention indicated generally by reference numeral 1, cathode 4 of which is coupled to the grid of the X-ray source of U.S. Pat. No. 4,723,263. The high current, high voltage, sharp pulse of the present invention is ideal for switching the grid of the X-ray source to release electrons from the cathode to anode and generate a propogating train of X-rays which sweep down the anode of the X-ray source.

If desired, the device can be constructed with the grid interposed between two symmetric planar electrodes (in a configuration similar to that disclosed in U.S. Pat. No. 4,670,894), each provided with an electron emitting surface so that, with appropriate electrical connections and switching, current can flow in either direction, or alternately.

Turning back now to the details of the actual implementation of the preferred embodiment shown in FIG. 1, 2, and 3, the switch tube 1 has a shell 12 formed of alumina ceramic coupled at each end to Kovar rings 14 with a ceramic/metal seal 16. A pair of stainless steel end caps 18 are welded to Kovar rings 14.

Anode 10 is preferably formed of tantalum. Although not shown, the outer face 10 of anode may be provided with fins to allow for better heat dissipation. Alternatively, anode 10 may be actively cooled by, passing a dielectric heat-transfer liquid (e.g. de-ionized water or freon) or gas (e.g. Argon or Helium) through channels drilled in anode 10.

As mentioned previously, cathode 4 is preferably a graphite foam sleeve mounted on a support structure 6, the central core of the foam sleeve having been previously machined out. A graphite felt lining could also be used for the cathode as in the parent application, but the foam sleeve appears to be vastly superior to any known electron emitting surface.

Cathode 4 and anode 10 are provided with broad flat connector straps 20 and 22, respectively, to minimize connector inductance and capacitance. Cathode support structure 6 is actually machined from the same piece as connector strap 20 to minimize impedance. Similarly, anode 10 and connector strap 22 are formed of the same material. Straps 20 and 22 are provided with apertures 24 and 26, respectively for coupling to further straps leading to −250 KV and ground, respectively.

The grid connector 27 is a standard ceramic fixture which can be readily connected to the output of a pulse transformer.

The switch tube of the invention is maintained under constant vacuum by four getter pumps, three of which are shown in FIGS. 1–3 and identified by reference numerals 28, 29, and 30. An initial vacuum is obtained by evacuating the device via exhaust tube 32.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A high voltage switch tube, comprising an elongated cold cathode, an elongated anode, and a grid which acts as a gate interposed between said cathode and said anode, said anode being axially symmetric to and enclosing said cathode and said grid, said cathode at a first potential, said anode at a second potential, and said grid rapidly switchable between potentials substantially the same as said first and second potentials, respectively, a pulse from said first potential to said second potential applied to said grid releasing electrons from said cathode toward said anode to generate a current flow on the order of $10^6$ amps, the voltage $KV_{peak}$ between said anode and cathode remaining substantially constant.

2. A high voltage switch tube as recited in claim 1, wherein said cathode, anode and grid are cylindrically symmetrical.

3. A high voltage switch tube as recited in claim 2, wherein said cathode is a graphite foam sleeve mounted on a support structure.

4. A high voltage switch tube as recited in claim 2, wherein said grid has the shape of a cylindrical set of longitudinally disposed Venetian blinds.

5. A high voltage switch tube as recited in claim 2, wherein said anode has the shape of a cylinder open at one end.

6. A high voltage switch tube as recited in claim 2, wherein the distance between said cathode and anode is at least four times the distance between said cathode and said grid.

7. A high voltage switch tube as recited in claim 1, wherein said cathode and anode are coupled to their respective first and second potentials by wide flat straps.

8. A high voltage switch tube as recited in claim 1, wherein said first potential is approximately −250 KV and said second potential is approximately ground.

9. A high voltage switch tube as recited in claim 1, wherein said grid is switched between said first and second potentials by a pulse from a pulse transformer.

10. A high voltage switch tube as recited in claim 1, wherein said cathode and anode are held under vacuum.

11. A high voltage switch tube as recited in claim 10, wherein said vacuum is maintained by getter pumps.

12. A high voltage switch tube, comprising first and second electrodes and a grid which acts as a gate interposed between said first and second electrodes, said first and second electrodes being and alternately oppositely connectable to first and second potentials such that in a first case when said first electrode is connected to said first potential, said second electrode is connected to said second potential, and in a second case when said first electrode is connected to said second potential, said second electrode is connected to said first potential, said grid being rapidly switchable between potentials substantially the same as said first and second potentials, a pulse from said first potential to said second potential applied to said grid in said first case releasing electrons from said first electrode to said second electrode to generate a current flow on the order of $10^6$ amps in one direction, a pulse from said second potential to said first potential applied to said grid in said second case releasing electrons from said second electrode to said first electrode to generate a current flow on the order of $10^6$ amps in a direction opposite to said first direction, the voltage between said first and second electrodes remaining substantially constant.

13. A high voltage switch as recited in claim 12, wherein said first and second potentials are alternately applied to said first and second electrodes to generate an alternating current.

14. A high voltage switch as recited in claim 1, wherein said anode is cooled by passing a dielectric fluid through channels drilled in said anode.

* * * * *